US007481741B1

(12) United States Patent
Sammann et al.

(10) Patent No.: US 7,481,741 B1
(45) Date of Patent: Jan. 27, 2009

(54) LADDER AND RELATED METHODS

(75) Inventors: Charles C. Sammann, Amarillo, TX (US); Trace A. McGuire, Amarillo, TX (US); Richard Hefley, Amarillo, TX (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 0 days.

(21) Appl. No.: 11/475,662

(22) Filed: Jun. 27, 2006

(51) Int. Cl.
*A63B 9/00* (2006.01)

(52) U.S. Cl. ..... 482/35; 482/37

(58) Field of Classification Search ..... 482/148, 482/35, 37; 182/194; 248/210
See application file for complete search history.

(56) References Cited

U.S. PATENT DOCUMENTS 4,231,448 A * 11/1980 Jensen ..... 182/93
4,724,925 A * 2/1988 Ritten ..... 182/97

* cited by examiner

*Primary Examiner*—Lori Amerson
(74) *Attorney, Agent, or Firm*—Hovey Williams LLP

(57) ABSTRACT

A ladder and attachment mechanism apparatus and methods are described herein. The apparatus preferably are of a modular design, and are especially useful for playground or similar equipment. Among other things, the apparatus and methods provide improved fabrication, construction, assembly, and ease of use in a variety of applications, and reduce manufacturing, inventory, shipping, assembly, and related costs. In one embodiment, the playground ladder includes a plurality of horizontal support members, a first lateral support member and a second lateral support member each having substantially the same size and shape and spaced apart from each other. Each lateral support member includes a plurality of corresponding sockets spaced along the length of opposite sides of each lateral support member thereby allowing the lateral support members to be interchangeable. Each socket is preferably configured to receive one end of one of the plurality of horizontal support members such that the plurality of horizontal support members are positioned therebetween to form the ladder. The upper end of the ladder can include handhold and/or attachment elements, and those handhold and/or attachment elements can also be used with conventional or other ladders, simulated rock walls, or other things.

9 Claims, 12 Drawing Sheets

LADDER AND RELATED METHODS

FIELD OF THE INVENTION

A ladder and related components, preferably of a modular design, for use in playground equipment, providing for, among other things, improved construction, assembly, and ease of use in a variety of applications, are described herein.

BACKGROUND OF THE INVENTION

Ladders have been provided for use by young children in ascending and/or descending playground equipment. Examples of such equipment include forts, swingsets, decks, slides, platforms, "treehouses", and the like, and the "ladders" may take various forms, including conventional ladders, simulated rock walls, etc. Such ladders may include user friendly design considerations such as smooth non-abrasive surfaces for hands and feet, natural inclines, and flat surfaces for ease of use, as well as being aesthetically appealing to encourage appropriate use. Such ladders exist in many forms and serve a variety of functions.

SUMMARY OF THE INVENTION

For the purpose of summarizing the invention certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

A ladder, preferably of a modular design, for use in playground equipment, providing for, among other things, improved construction, assembly, and ease of use in a variety of applications, is described herein.

In one embodiment, the playground ladder includes a plurality of horizontal support members, a first lateral support member and a second lateral support member each having substantially the same size and shape and spaced apart from each other. Each lateral support member includes a plurality of corresponding sockets spaced along the length of opposite sides of each lateral support member thereby allowing the lateral support members to be interchangeably positionable. Each socket is preferably configured to receive one end of one of the plurality of horizontal support members such that the plurality of horizontal support members are positioned therebetween to form the ladder. The horizontal support members are preferably held in place by a horizontal support member securing means such as a wood screw, bolt, or similar device.

Preferably, each lateral support member further includes openings or spacing between each successive socket along the length of each lateral support so as to form handholds along one side of the lateral support member.

Preferably, each lateral support member further includes a cap member positioned at one end. The cap member includes an arm extending outward from the lateral support member. The arm is configured to contact a horizontal section of playground equipment to secure the lateral support member to the playground equipment by a lateral support member securing means. The contacted/secured surface is shown herein as horizontal (such as the top/upper surface of decking), but may include any suitable attachment configuration, such as attachment to a vertical surface, attachment to the bottom of the horizontal deck or other portion, a combination of the foregoing, etc.

Preferably, the cap member further includes a stop lip positioned between the lateral support member and the arm. The stop lip is configured to contact a side portion of a vertical section of the playground equipment. Among other things, this can facilitate assembly, reduce stress on the lateral support member securing means, and otherwise strengthen the joint.

These and other embodiments, objects, and advantages will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 7 is similar to FIG. 4, but illustrates one of the many different "top" shapes for the cap, to provide a convenient handhold.

DETAILED DESCRIPTION

Figure 1:
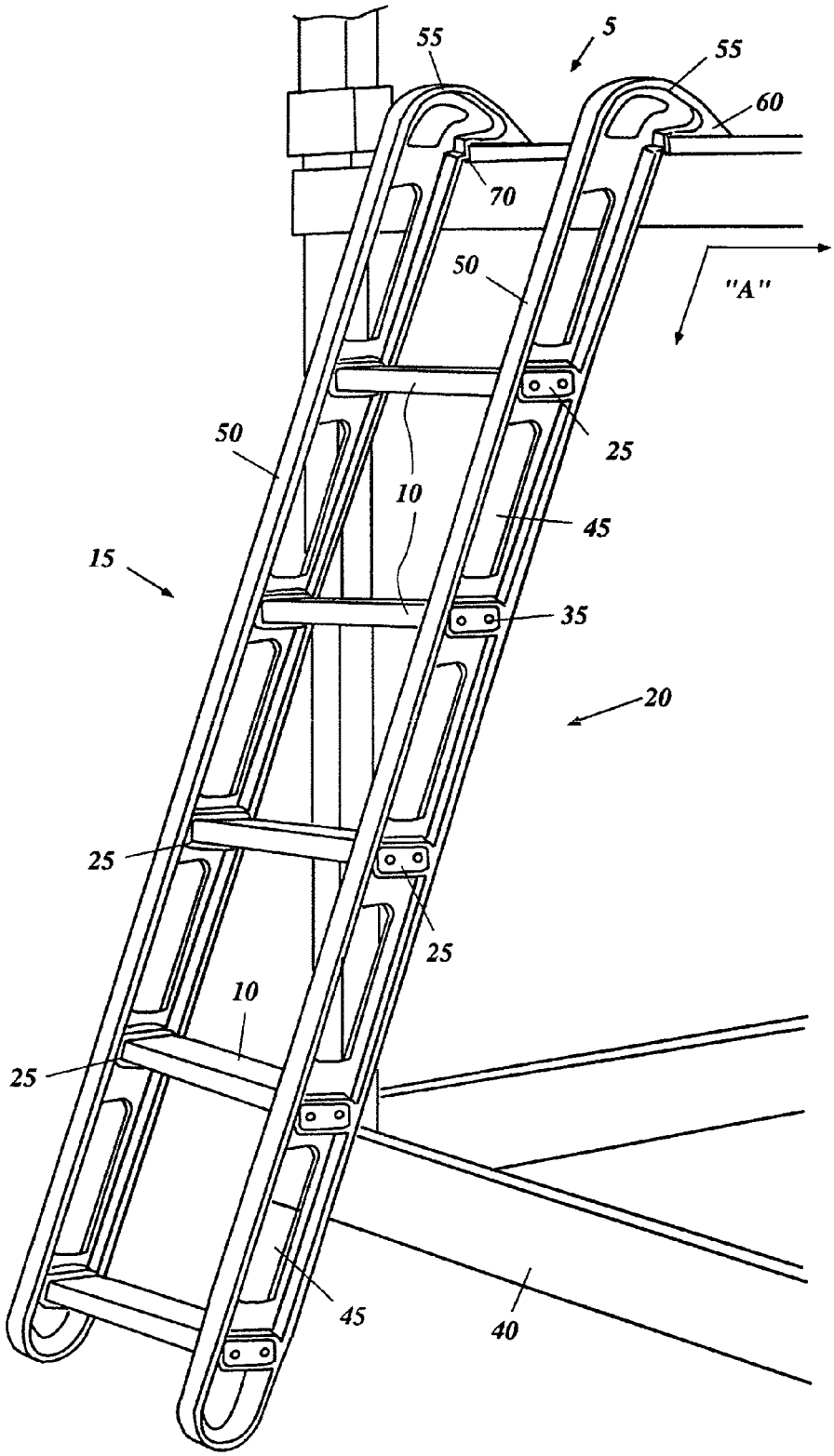
FIG. 1 shows one embodiment of a ladder having a plurality of rungs or other horizontal support members, a first rail or lateral support member and a second rail or lateral support member each having substantially the same size and shape, and sockets spaced along the length of opposite sides of each lateral support.

Embodiments of the present invention will now be described with references to the accompanying Figures, wherein like reference numerals refer to like elements throughout. The terminology used in the description presented herein is not intended to be interpreted in any limited or restrictive manner, simply because it is being utilized in conjunction with a detailed description of certain embodiments of the invention. Furthermore, various embodiments of the invention (whether or not specifically described herein) may include novel features, no single one of which is necessarily solely responsible for its desirable attributes or which is essential to practicing the invention herein described.

The invention may be fabricated from any suitable material (wood, plastic, metal, etc.) and in any useful dimensions and configurations. Various combinations of materials and fabrication and assembly methods may be especially useful, including without limitation the examples described herein.

Turning now to FIG. 1, a ladder 5, preferably of a modular design, for use in playground equipment, providing for, among other things, improved construction, assembly, and ease of use in a variety of applications, is shown. The ladder 5 includes a plurality of horizontal support members 10, and a first lateral support member 15 and a second lateral support member 20 each having substantially the same size and shape and spaced apart from each other.

Preferably, the lateral support members or rails 15, 20 are formed as a single piece of plastic in an injection-molded process that ensures uniformity of construction, as well as a lightweight, durable, smooth (i.e., splitter free when compared to a wooden rail) and corrosion-resistant element. The injection-molded process allows the rails 15, 20 to be manufactured in a various colors or color combinations to create an aesthetically appealing product. Preferably, the horizontal support members or steps 10 are constructed of wood. However, person of ordinary skill in the art will understand that the entire ladder 5 or any portion thereof may be constructed of plastic, wood, metal, a composite material, or any combination thereof.

Each lateral support member 15, 20 preferably includes a plurality of corresponding sockets 25 spaced along the length of opposite sides of each lateral support member 15, 20. In this regard, the corresponding sockets 25 are formed directly opposite each other on the sides of the lateral support member 15, 20. As such, the sockets 25, configured to receive one end of one of the plurality of horizontal support members 10, are capable of receiving horizontal support members 10 on either side of the lateral support member 15, 20. When positioned between a pair of lateral support members 15, 20, the horizontal support members 10 and lateral support members or rails 15, 20 form a ladder 5. Additional or different horizontal members 10 and rails 15, 20 can be used to form more complex ladder assemblies, as discussed below and illustrated, for example, in FIG. 5.

Positioning of sockets 25 on both sides of the lateral support member 15, 20 permits the lateral support members or rails 15, 20 to be interchangeably positionable. In other words, the ladder rails 15, 20 are substantially identical and each can be used as either a right or left hand positioned lateral support member 15, 20. Such universal application simplifies the manufacturing process and reduces packaging errors by eliminating the need to produce different parts for a left and right hand positioned lateral support member.

Figure 5:
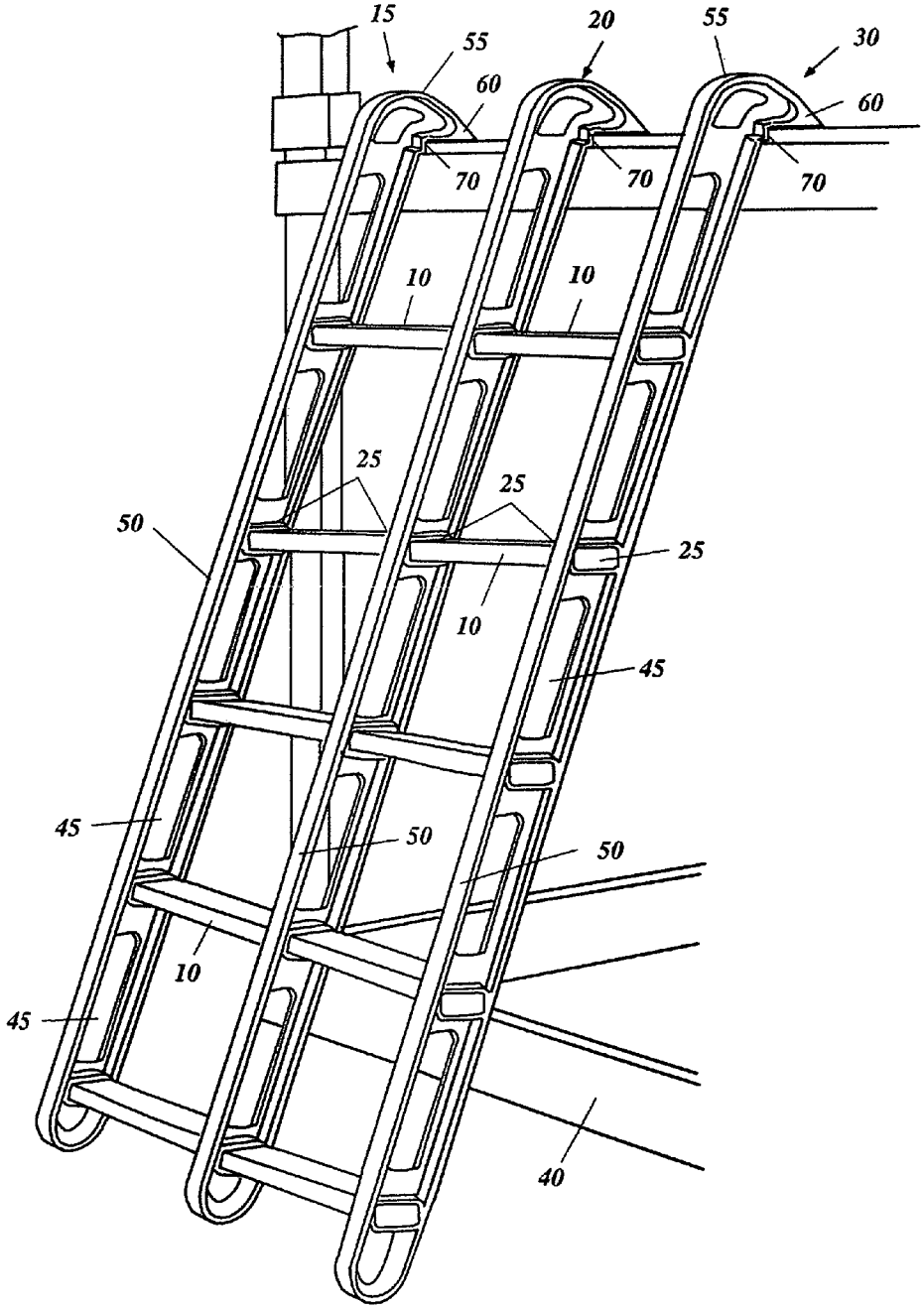
FIG. 5 shows a multi-section or side-by-side ladder arrangement made possible by sockets being formed on both sides of a lateral support member. Persons of ordinary skill in the art will understand that the "center" or middle rail or rails of such embodiments could alternatively be provided in the form of one or more rails such as shown in FIG. 9*a*, which would permit the use of longer or even "full-width" rungs that pass through the open sockets from one side of the ladder to the other.
Figure 6A:
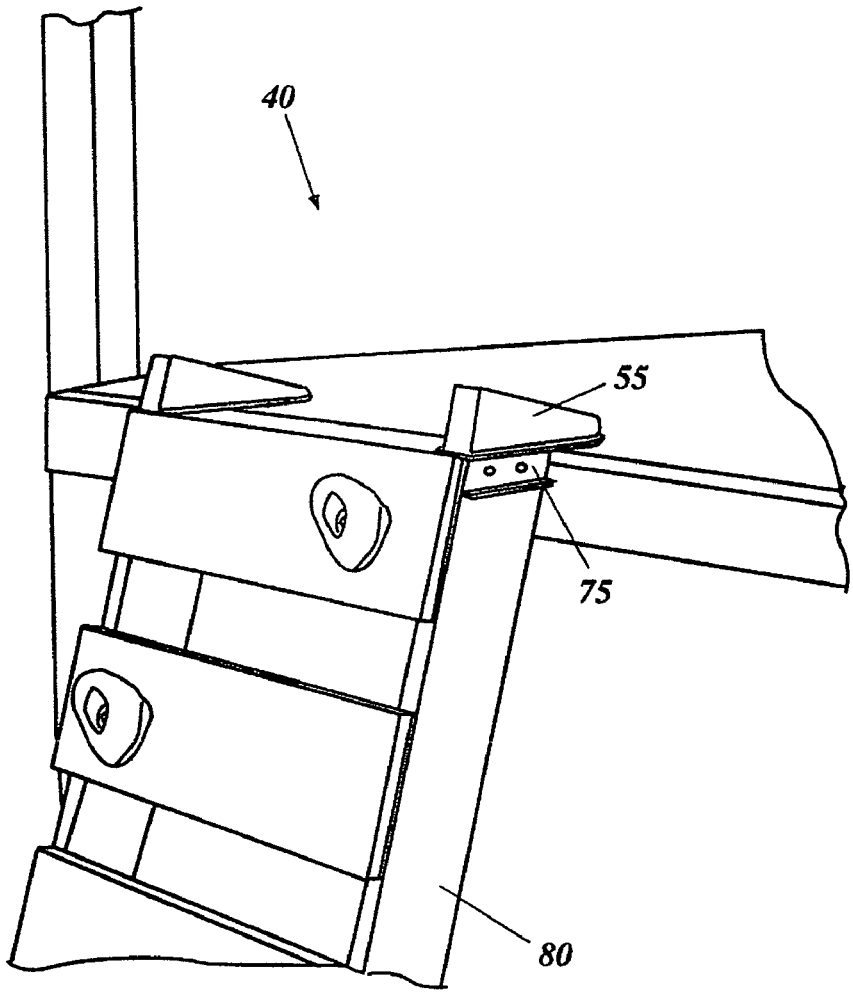
FIG. 6*a* shows an example of the cap member of FIG. 4 being used to attach an inclined object (such as a simulated rock wall) to a piece of playground equipment.
Figure 6B:
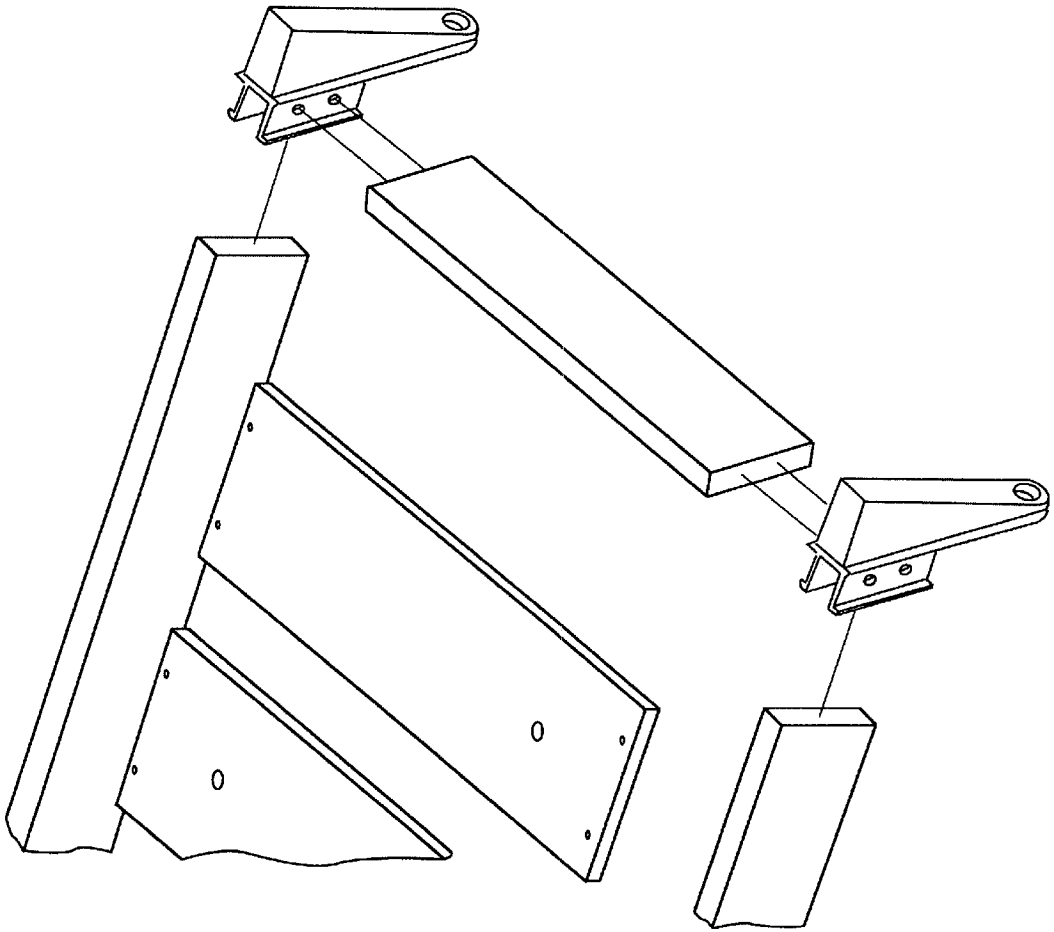
FIG. 6*b* shows an exploded view of the cap member of FIG. 6*a*.
Figure 6C:
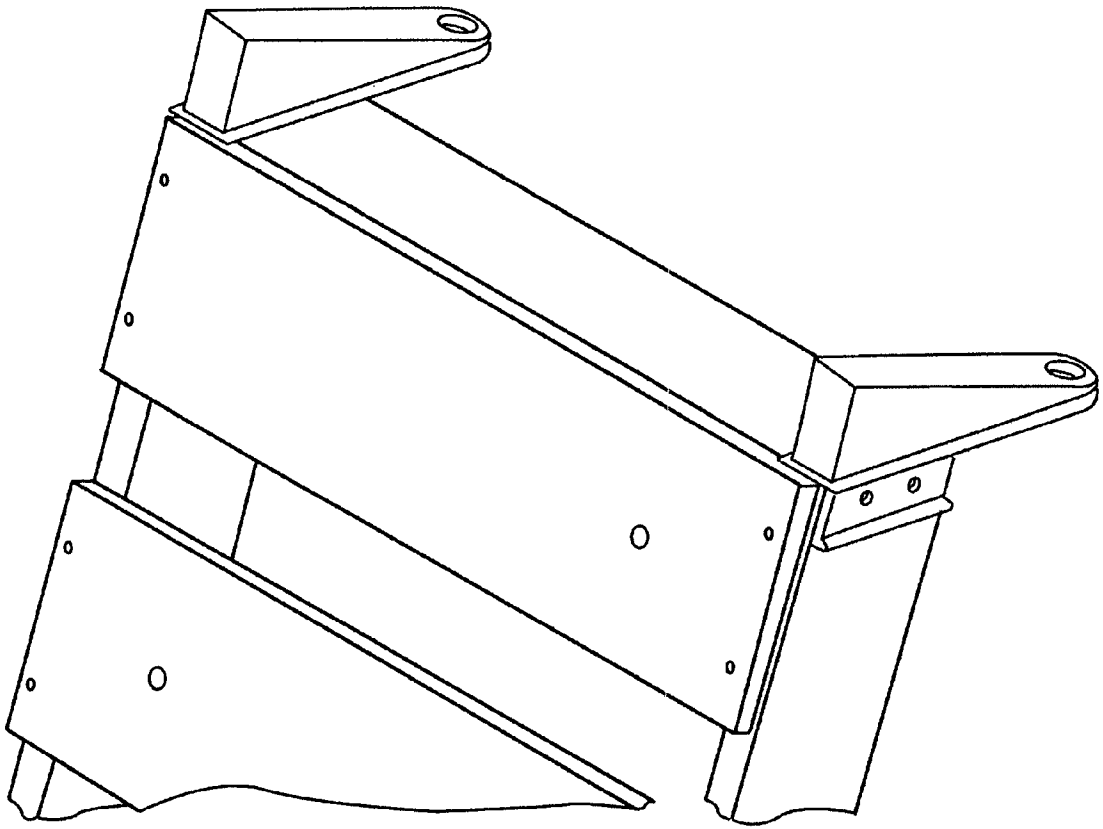
FIG. 6*c* shows the cap member of FIG. 6*a* attached to an inclined object, such as a simulated rock wall.
Figure 6D:
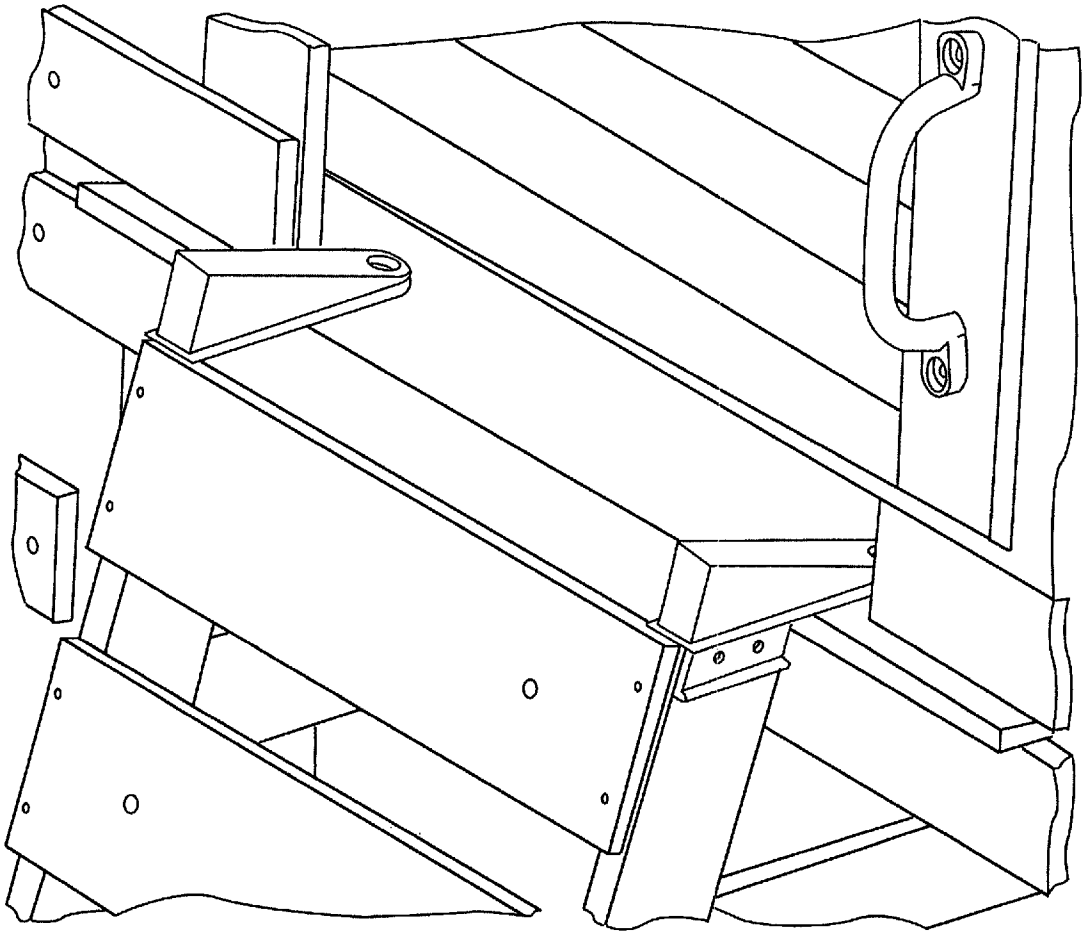
FIG. 6*d* is similar to FIG. 6*a* and shows an example of the cap member of FIG. 4 being used to attach an inclined object (such as a simulated rock wall) to a piece of playground equipment.
Figure 10:
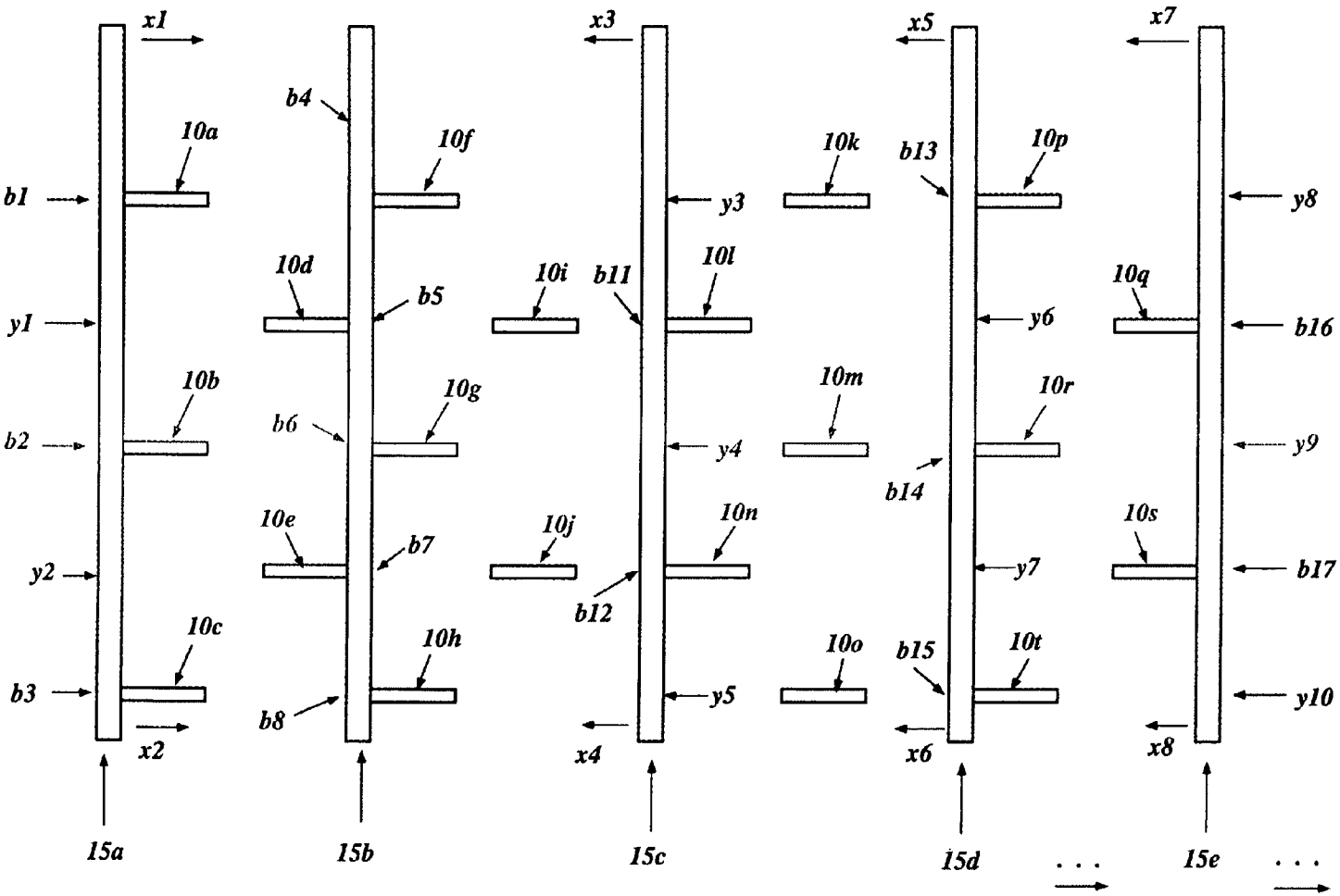
FIG. 10 is an exploded view of a multi-rail assembly such as shown in FIG. 5, illustrating one of the many methods of assembly of same, as well as showing how it can be used to assembly even larger embodiments (having as many rail members as may be desired).

Furthermore, as shown in FIG. 5, positioning of the sockets 25 on both sides of the lateral support member 15, 20 permits the use of three lateral support members or rails 15, 20, 30 to form two side-by-side ladders (or four rails to form three side-by-side ladders, etc.; see also FIG. 10). Horizontal support members 10 are simply received into the sockets 25 along the length of both sides of a single center rail 20 while the outermost or extreme right and left hand positioned rails 15, 30 each receive the opposite ends of those same horizontal support members 10.

Preferably, the horizontal support members 10 are held or secured in place by a horizontal support member securing means 35 such as one or more wood screws, bolts, or similar devices (or combination thereof). Preferably, the securing means passes through one or more holes 26 formed in the base (or central web) 27 (see FIGS. 2*d* and 2*e*) of the socket 25 on one side of the lateral support member 15, 20 to the socket 25 on other side of the lateral support member 15, 20 to contact and hold the horizontal support member 10 within its associated socket 25. Persons of ordinary skill in the art will understand that when positioning horizontal support members 10 on both sides of a lateral support member 15, 20 an alternative method must be utilized to secure the oppositely positioned horizontal support members 10. Such an alternative method may include the technique used in the assembly of many cabinets, which would place a bolt through the socket 25 on one side of the rail 15, 20 to the step 10 positioned within the socket 25 on the other side of the rail 15, 20. A come-along type nut is then positioned in an orifice on an exposed portion (preferably the underside) of the step 10 and is used to draw the bolt toward the step 10 to secure the step 10 in place.

Persons of ordinary skill in the art will understand that the dimensions and configuration of the ladder 5 and its components (including width, length, and distance between the horizontal support members 10 and/or lateral support members 15, 20 and angle "A" of the ladder 5 when positioned against the elevated deck or other object of its use) may vary according to the intended application of the ladder 5. For example, the width of the horizontal support members 10 and therefore the associated sockets 25 and lateral support members 15, 20 and/or angle "A" of the ladder 5 may be increased, as compared to a standard ladder step having round dowel steps, to provide better footing and a secure feeling for children and young adults.

For multi-section embodiments such as shown in FIG. 5, the horizontal length of each "set" of rungs 10 (a "set" being those between a single pair of rails 15/20) preferably is substantially the same, but the "sets" can be of varying lengths (so that the rails may not be equally spaced from each other).

Alternative embodiments (not shown) would include ladders having a single rung or horizontal support member), and/or ones in which the rails are not parallel (they get closer together or farther apart near the top of the ladder) and/or are not straight (they are formed in an S or C or other more complicated shape), or are parallel to each other but sloped to the right or left as a user approaches the unit (so that climbing the ladder involves climbing to the left or right as the user moves up the ladder).

Preferably, the ladder 5 is modular in design, allowing the ladder 5 to be assembled onsite, preassembled, or in any other convenient location or at any other convenient time. As indicated above, the interchangeability of the rails 15, 20 permits a ladder 5 to be assembled, put into place, and ready for use relatively easily. In the preferred embodiment, the rails 15/20 are identical and are therefore interchangeable, which provides many benefits. By way of example and not by way of limitation, the assembler cannot mix up the rails, a manufacturer or retailer's inventory of parts does not need to include "right" and "left" rails, packaging of unassembled kits is simpler (two generic rails, rather than one right rail and one left rail), replacement of a damaged rail does not require knowing whether it is right or left, etc, Although the ladder 5 may be used for various applications, the preferred use of the ladder 5 is in the ascent and/or descent of playground equipment 40 such as forts, platforms, decks, slides, or similar structures.

As shown in FIG. 1, in one embodiment, the ladder 5 is configured to be angled "A" toward the playground equipment 40. Preferably the ladder 5 is angled "A" such that a natural incline is formed to facilitate ascent and descent of the ladder. However, persons of ordinary skill in the art will understand that the invention can be used with a wide range of angles, dimensions, and other criteria.

Each lateral support member 15, 20 preferably includes one or more openings or spacing 45 between each successive socket 25 along the length of each lateral support member 15, 20. In addition to reducing the weight of the part and improving the costs and output quality of certain manufacturing processes (such as injection molding), those openings preferably are sized and configured so as to form one or more handholds 50 integrally within the lateral support member or members 15, 20. In this regard, the spacing 45 preferably is sufficiently large such that the handholds 50 formed on the side of the rail 15, 20 can be utilized to assist persons ascending and/or descending the ladder 5.

Although the width of the rail 15/20 does not have to be consistent along its length, the preferred embodiment provides that consistency, so that the rail has an edge flange 46 preferably the same width around its entire perimeter. Even for embodiments without openings 45, this flange 46 can function as a hand hold or grip along the entire (or substantially the entire) length of the rail 15/20.

Figure 2A:
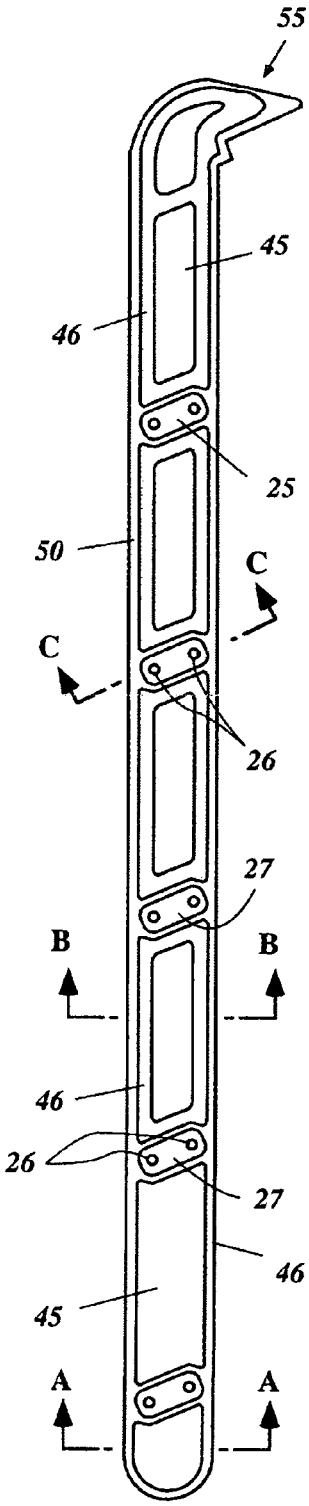
FIG. 2*a* shows the lateral support member of FIG. 1.
Figure 2B:
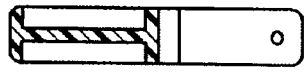
FIG. 2*b* illustrates a cross section taken along line A-A in FIG. 2*a*.
Figure 2C:
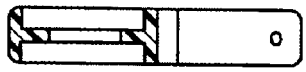
FIG. 2*c* illustrates a cross section taken along line B-B in FIG. 2*a*.
Figure 2D:
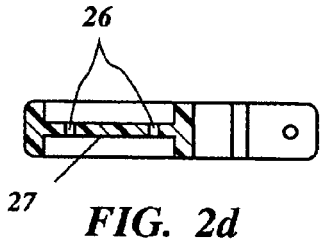
FIG. 2*d* illustrates a cross section taken along line C-C in FIG. 2*a*.
Figure 2E:
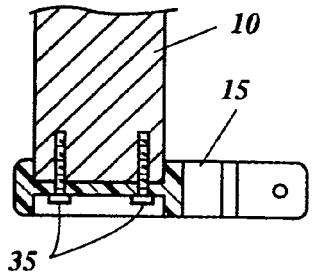
FIG. 2*e* is similar to FIG. 2*d*, but illustrates a cross section of a preferred assembly (rather than just the ladder rail 15/20), including preferred lag bolts 35, step or rung 10, holes 26, and other features.
Figure 9A:
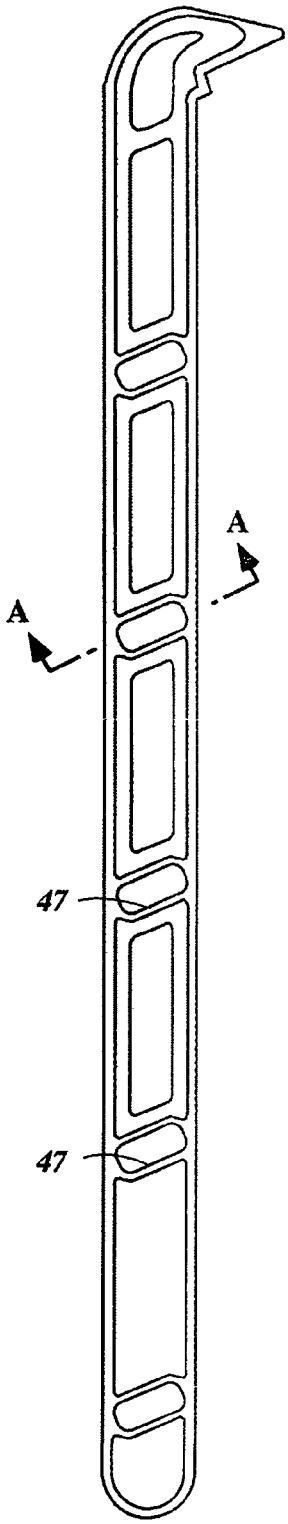
FIG. 9*a* is similar to FIG. 2*a*, but illustrates another of the many alternative embodiments of the rail element of the invention.
Figure 9B:
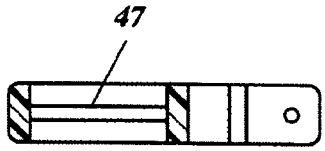
FIG. 9*b* illustrates a cross section taken along line A-A in FIG. 9*a*.

As mentioned above, alternative embodiments of the rail can include ones such as shown in FIGS. 9*a* and 9*b*. The principal difference between the rails of FIGS. 2*a* and 9*a* is that, instead of flanges 27 with holes 26 (see FIGS. 2*a* and 2*d*), the embodiment of FIG. 9*a* is a hollow, open, or pass-through section 47 where no flange 27 is formed. As a consequence, a rung or step 10 can be inserted through that opening 47, and extend outwardly into "air" (without any further rail in that direction) or to/through a further rail member 15/20. Assemblies such as FIGS. 5 and 10 can thus be readily configured and assembled from the modular parts of the invention, without the need for differently shaped pieces.

Persons of ordinary skill in the art will understand that, depending on the application, rails can be provided with any number or combination of sockets, some having flanges 27 with holes 26 (FIG. 2*d*), others having openings 47 therethrough (as in FIGS. 9*a* and 9*b*), etc.

Figure 3:
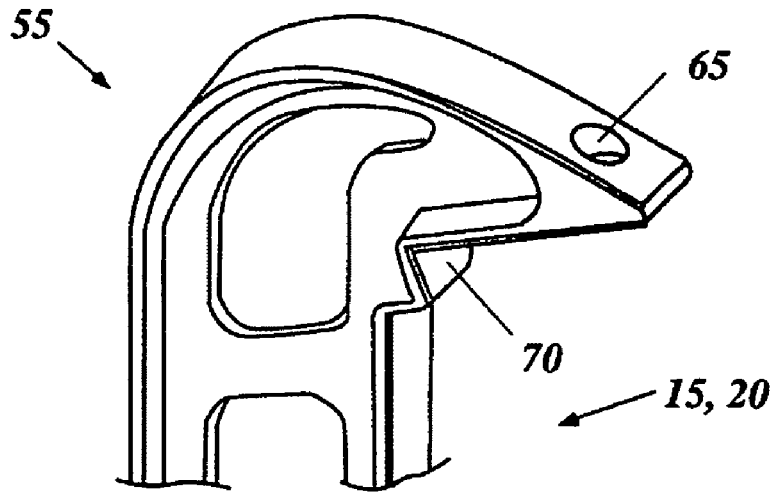
FIG. 3 is an isometric view of the upper end of a rail from FIG. 1, showing details of that cap member having an arm extending outward for contacting a horizontal surface and a stop lip for contacting a vertical surface.

A preferred method of assembling more complex ladder structures is illustrated in FIG. 10. It is convenient to begin with rail element 15*b*, and affix to it a plurality of rungs 10 *d/e/f/g/h*. In this preferred method, those rungs are staggered on opposing side (in the sockets on those opposing sides) and affixed to an "interior" rail 15*b* by any suitable means (such as by bolts b4/b5/b6/b7/b8, screws, etc.). If helpful, rail 15*b* can be affixed to the equipment decking via a bolt/screw through flange opening 65 (FIG. 3), either as an initial step or before adding further rails/rungs. To "end" the assembly in either direction (to the right or left, as shown in FIG. 10), rungs can be inserted into the "open" sockets (ones with no rail yet inserted) on the rail 15*b* in the direction of arrows x1 and x2, or (as shown in FIG. 10) can be affixed to an end rail 15*a* via bolts/screws b1/b2/b3 and then that entire assembly (end rail 15*a* and steps 10*a/b/c*) inserted into engagement with the 15*b* assembly in the direction of arrows x1 and x2. As with the interior rail, if helpful, the end rail 15*a* can be affixed to the equipment decking via a bolt/screw through flange opening 65 (FIG. 3). Additional or alternative structural integrity can be provided via screw/bolts y1/y2, through the end rail 15*a* and into the rungs 10*d* and 10*e*.

To achieve the dual set embodiment shown in FIG. 5, the same steps just explained can be repeated using rail 15*e* (FIG. 10), whereby none of the intermediate rails (15*c*, 15*d*) or their respective rungs would be used. Instead, rungs 10*q* and 10*s* would be positioned between rungs 11*f*, 10*g*, and 10*h*, and assembled in the manner just described. In such an assembly, rails 15*a*, 15*b*, and 15*e* would end up configured in an "adjacent" relationship such as rails 15, 20, and 30 in FIG. 5.

For even more complex assemblies, further intermediate rails and rungs can be assembled as shown with elements 15*c*, 15*d* (and repeating as many times as desired) in FIG. 10. One or more intermediate rail assemblies such as 15*c* (with rungs 10*l* and 10*n* held by screws b11 and b12) and 15*d* (with rungs 10*p*, 10*r*, and 10*t* held by screws b13, b14, and b15) can be assembled from the modular components described herein, and then assembled together with the previously assembled elements (15*a* and 15*b* and their rungs). As each new intermediate rail is assembled (such as rail 15*c* being assembled as shown by arrows x3 and x4), the "missing" rungs can be interposed (loosely, or with glue or other adhesive, etc.) into the open sockets. Thus, as rail 15*c* is brought into the assembly, rung 10*i* is inserted into the sockets so that its ends abut the heads of bolts b5 and b11, and rung 10*j* is inserted into the sockets so that its ends abut the heads of bolts b7 and b12. Bolts or screws y3, y4, and y5 (or some of those) can then be inserted to "fix" rail 15*c* to the overall assembly. A similar process can then be used to assemble rail 15*d* (and its rungs 10*p/r/t* screwed on via screws b13/b14/b15) to the assembly and "trap/hold" rungs 10*k/m/o* in place between the sockets of bolts y3/b13, y4/b14, and y5/b15, respectively. The end rail 15*e* (or 15*f/g/h*/ . . . , not shown) can then be assembled to form the right-hand end of the ladder/climbing apparatus, similar to the assembly of rail 15*a* described above. One or more of the bolts y8, y9, y10, b16, and/or b117 can be used to secure the end rail 15*e* to the overall assembly. As mentioned above, one or more of the rails 15*a*, 15*b*, etc. can be affixed to the equipment decking via a bolt/screw through their respective flange opening 65 (FIG. 3), or by any other suitable means.

In alternative embodiments, glue or other adhesive (or sonic welding, etc.) can be used alone, or in various combinations with bolts or screws, to fix the interior ends of the rungs to the adjacent rails. In perhaps the simplest method to provide such multi-rail embodiments, each successive set of rungs can be glued to each rail after the rail has been screwed or affixed to the deck (via a bolt/screw through flange opening 65 or otherwise), then the next rail can be put into position (with glue or bolts/screws through that new rail and into the ends of the abutting rungs). If desired, the top of that new rail can be affixed to the equipment deck, more rungs inserted and/or glued into the opposite side of those sockets, another rail placed over the opposing ends, and so on.

Other of the many alternative embodiments of the invention can use one or more rails having pass-through openings 47 such as shown in FIGS. 9*a* and 9*b*. These pass-through rails can be used for interior and/or end rails. In such embodiments, the foregoing assembly method can be modified and/or simplified, even to the point of having "full width" rungs or horizontal members 10 that extend the entire width of the assembly, from one outer rail member (such as rail 15*a*) through one or more central rail members (such as rails 15 *b*, *c*, and *d*) to the other outer rail member (such as rail 15*e*), without being broken into pieces. For increased structural integrity or otherwise, the rungs or other horizontal members may be "mixed", so that some extend further than the space between adjacent rails 15, while others do not and are "fixed" to the interior rails.

For purposes of maintenance or repair, the foregoing method steps can simply be reversed to the point needed to replace the broken piece, and then reassembly can proceed as above. If glue was used in the assembly, any such disassembly may be more difficult and/or may require the use of a solvent or other treatment to soften or destroy the glue bond.

Preferably, each lateral support member 15, 20 further includes a cap member 55 positioned at one end. The cap 55 can be any suitable size or shape, but preferably serves one or more of the functions described herein.

Figure 4:
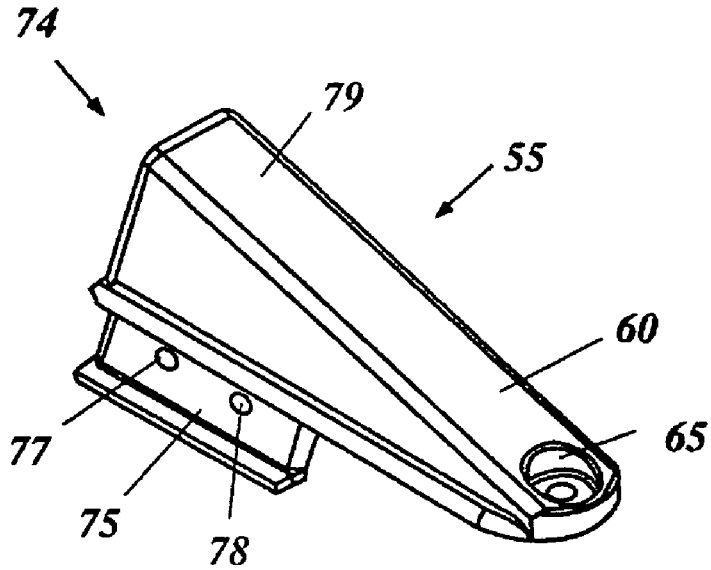
FIG. 4 shows an alternative embodiment of the cap member of FIG. 3. As explained below, this cap can be incorporated onto the top of a ladder rail such as the rails of FIG. 1, or can be provided as a separate true "cap" for the upper end of a rail member (such as an upright 2×4 or similar element), with two descending elements such as elements 75 in FIG. 7.
Figure 7A:
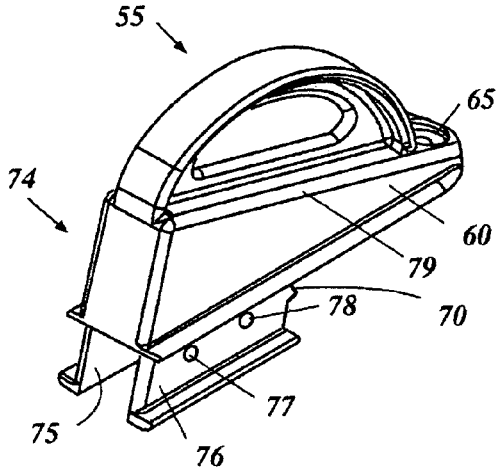
FIGS. 7*a* and 7*b* are elevation and end views of the cap member of FIG. 7.

In one embodiment, the cap member 55 is integrally formed with the lateral support member 15, 20 during the injection-molded process. Alternatively, as described below, the cap member 55 may be formed as a separate piece, and added to the lateral support member 15, 20. For embodiments in which the cap member 55 is affixed to the top of a lateral support member such as a convention rail on a ladder, a simulated rock wall, or the like (see, for example, FIG. 7*a*), the cap member 55 includes a body portion 74 having two flanges 75, 76 extending therefrom and configured to extend along the sides of a rail 15, 20. Typically, the body portion 74 is shaped to correspond to the shape of the rail end on which it is added or attached. For those cap members 55 shown in at least FIGS. 4, 7*a*, and 8*a* the body portion 74 is substantially triangular in shape having a sloped or slanted top edge 79.

Preferably each flange 75, 76 includes holes 77, 78 to permit a bolt/screw/etc. to pass through one of the flanges 75, through a corresponding rail 15, 20 and then through the other flange 76.

The cap member 55 preferably includes another flange, arm, or appendage 60 extending from the body portion 74. Preferably, the arm 60 is configured to contact a top surface or portion of a horizontal section of the playground equipment 40, and is used to secure the lateral support member 15, 20 to the playground equipment 40. Although many benefits of the invention can be realized by simply resting the arm 60 on the deck or other horizontal section of the playground equipment 40, preferably, a lateral support member securing means (not shown) secures the lateral support member 15, 20. Such a lateral support member securing means may include any suitable method or apparatus of connection, including glue, Velcro, or a wood screw or bolt that passes through an orifice 65 in the arm 60 into the playground equipment 40.

In one embodiment, the cap member 55 further preferably includes a stop lip 70 positioned generally between the arm 60 and the body portion 74 of the lateral support member 15, 20. As shown in FIGS. 1, 2*a*, 3, 5, 9*a*, the stop lip 70 protrudes in a generally outward direction from the cap member 55 and is preferably configured to contact an outside portion of a vertical section of the playground equipment 40. The addition of the stop lip 70 to the lateral support member 15, 20 provides several advantages, including reducing pivotal stress on the lateral support member securing means, such as when the ladder is lifted up from the bottom, when compared to a cap member 55 without such a stop lip 70.

As indicated above, the cap member 55 may be molded or formed to have a shape conducive to its intended application. As examples, the cap member may be generally curved (shown in FIGS. 1 and 5) or generally triangular (shown in FIG. 4) in shape with side portions 75 extending downward to facilitate attachment of the cap member 55 to a ladder 5 or other suitably positioned inclined object. For example, as shown in FIGS. 6*a*-6*d*, the cap member 55 may be used to secure a rock wall 80 to a floor that forms a portion of playground equipment 40 such as a fort.

More particularly, the cap member 55 of FIGS. 6*a*-6*d*, preferably provides a means of attaching an inclined object such as the rock wall 80 to a piece of playground equipment 40. Preferably, the side portions 75 of the cap member 55 are secured to the inclined object 80 by a securing means such as a screw, bolt or similar device (not shown) that passes through an orifice 65 in the cap member 55 and into the top portion of a horizontal section of the playground equipment 40. This arrangement allows the inclined object 80 to be mounted or attached flush with the top edge of the playground equipment 40 thus eliminating any gaps that may exist along the top edge where the inclined object 80 meets the playground equipment 40 (such as between the top "rung" and the edge of the decking) that may cause a child's fingers and/or toes to become pinched or lodged in the gap or available space.

Similar to the lateral support members 15, 20 mentioned above, the cap members 55 are preferably substantially the same size and shape to allow interchangeability of the cap members 55.

Figure 7B:
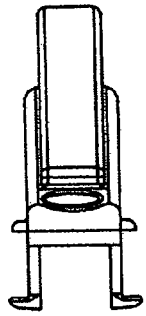
Figure 8A:
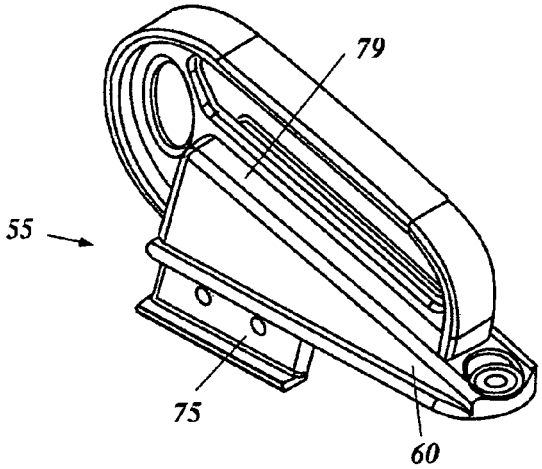
FIGS. 8*a* and 8*b* are similar to FIGS. 7*a* and 7*b*, but illustrates yet another of the many configurations and embodiments of the upper/cap element of the invention.
Figure 8B:
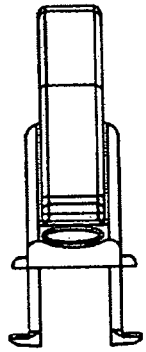

In addition to providing a means of attaching the ladder 5 or other inclined object to a particular piece of playground equipment 40, the shaped section (curved, triangular, etc.) of the cap member 55 may serve as a handhold to assist in ascending or descending the inclined object. In this regard, as shown in FIG. 7, the cap member 55 may further include a handhold area such as the curved appendage 85 extending from the top of the generally triangular shaped cap member 55. Persons of ordinary skill in the art will understand that the designated handhold may a encompass a variety of shapes to accomplishes the desired result of assisting individuals ascend and descend an inclined object such as a ladder 5 or rock wall 80. Further examples of the many alternative embodiments of this feature are illustrated in FIGS. 8*a* and 8*b*.

Figure 11:
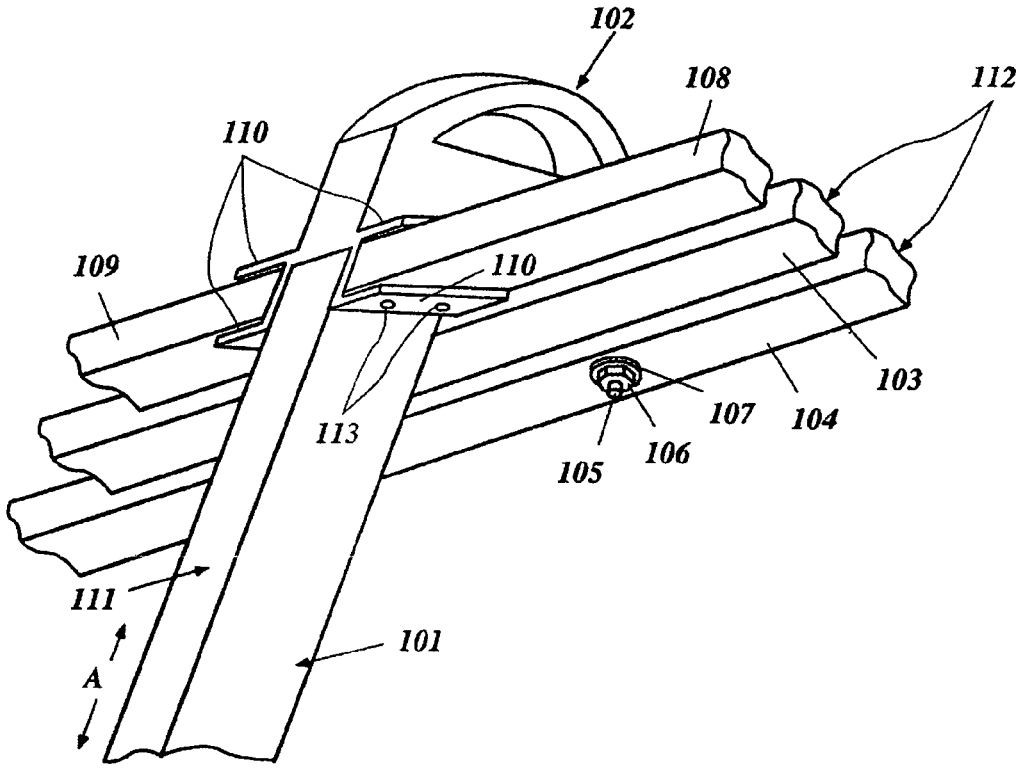
FIG. 11 is a partial isometric view of another embodiment of the invention.

Among the many alternative embodiments of the invention, some permit attachment of a "rung"—like member as a top "step" or sitting surface, that abuts and effectively "extends" (with little or no "gap") a deck or similar surface on a playset, fort, treehouse, or other backyard exercise equipment. The further rung/step at the top of the incline can be affixed in any suitable manner, including via the vertical flange elements shown in FIG. 7 (with or without one or more horizontal extensions formed to underlie and/or support the further rung/step). One such embodiment is shown in FIG. 11 as including a cap member 102 (similar to the one shown in FIGS. 7*a* and 7*b*) assembled with a ladder rail 101 and to abut platform decking 103 and 104, with the cap member 102 held in place via a bolt 105, nut 106, and washer 107 combination (inserted through a hole on the upper side of the cap 102, not shown, and protruding through the decking members 103/104). The cap 102 preferably includes one or more lips or flanges or ledges 110 formed integrally with the body of the cap, to provide support for further horizontal planks or "decking" members 108/109. As indicated above, the plank or planks preferably are configured to fill or reduce any gap that might otherwise occur between the outermost piece of "normal decking" 103 (the decking as it would be without the ladder or rock wall of the invention) and any step or rung or rock wall plank (not shown) that may be affixed to the outer surface 111 of the upright 101. Persons of ordinary skill in the art will understand that any such rail 111 may be positioned, for example, at any suitable height along the upright 101 in the direction indicated by the arrows A-A in FIG. 11, and that the plank or planks 108 and 109 can ensure that the ladder assembly complies with any applicable government or other regulations for safety or the like.

Although the drawings and descriptions herein primarily focus on ladders, rock walls, or the like that are inclined or sloped with respect to playground equipment and/or the ground or other supporting surface, persons of ordinary skill in the art will understand that the ladder rails or uprights can be at any suitable angle for a desired application, including completely or substantially vertical.

Other alternatives for affixing that further rung/step to the cap include providing means for positively fixing the supplemental planks 108/109 to the cap or bracket 102. Among others, such means can include as at least one horizontal flange 110 (FIG. 11) that extends sufficiently under and/or over the horizontal member to permit insertion of screws, bolts, or the like upwardly or downwardly through that flange (such as through holes 113) and into the horizontal member 108/109. For embodiments in which one or more further cap members (not shown) are fixed to the playground equipment decking 103/104 at the remote ends of the further rungs/steps 108/109 (or those remote ends are fixed against lateral movement in some other manner), the further rung/step 108 and/or 109 may simply rest within the horizontal/vertical support flanges 110 without the need for screws or bolts into the further rung/step 108 and/or 109. In such embodiments, the fixation of the cap members 102 to the upper surface 112 of the "normal decking 103/104 will prevent the cap members from moving laterally apart, and thereby prevent the flanges 110 from becoming disengaged from the further rung/step 108/109.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A ladder for playground equipment comprising:

a plurality of support members;

a first lateral support member and a second lateral support member spaced apart from each other, the first lateral support member and the second lateral support member each having substantially the same size and shape so as to be interchangeable, each lateral support member includes a plurality of corresponding elongated sockets spaced along the length of opposite sides of each lateral support member thereby permitting support members to be received on opposite sides of the first and second lateral support member, each socket configured to receive one end of one of the plurality of support members such that the plurality of support members are positioned therebetween to form the ladder, each socket configured to position each support member horizontally when the lateral support members are positioned at an angle other than perpendicular to the playground equipment, the support members held in place by a support member securing means, wherein a cap member is positioned at the top end of each lateral support member, the cap member includes a body portion, and an arm extending outward from an upper section and a lower section of the body portion to contact a horizontal surface of the playground equipment to secure the lateral support member to the playground equipment by a lateral support member securing means extending though an orifice in the arm, wherein each cap member includes a stop lip having a first surface and a second surface, the stop lip positioned between the lateral support member and the arm and extending outward from the body portion, the first surface of the stop lip configured to contact a generally vertical surface of the playground equipment, the second surface of first stop lip configured to position the lateral support member a distance from the playground equipment.

2. The ladder of claim 1, wherein each lateral support member further includes an opening between successive sockets along the length of each lateral support, said openings providing hand holds along the lateral support member to assist in ascending or descending the ladder.

3. A cap member for a playset lateral support member, comprising:

a body portion;

an arm extending outward from an upper section and a lower section of the body portion, the arm configured to contact a horizontal surface of the playset and receive a first connecting member to removeably secure the ann to the playset; and a first flange extending from the body portion, the first flange configured to contact a first outside surface of an end portion of the lateral support member and receive a second connecting member to removably secure the first flange to the lateral support member, wherein the cap member includes a first stop lip having a first surface and a second surface, the first stop lip positioned between the first flange and the arm and extending outward from the body portion, the first surface of the first stop lip configured to contact a generally vertical surface of the playset, the second surface of the first stop lip configured to position the lateral support member a distance from the playset.

4. The cap of claim 3, further including a second flange extending from the body portion and spaced apart from the first flange so as to receive the outside surface of lateral support between the first flange and the second flange, the second flange configured to contact a second outside surface of the end portion of the lateral support opposite, second outside surface being opposite to the first outside surface, the second flange configured to receive a third connecting member to removably secure the second flange to the lateral support member.

5. The cap of claim 4, wherein the cap member includes a second stop lip having a first surface and a second surface, the second stop lip positioned between the second flange and the arm and extending outward from the body portion, the first surface of the second stop lip configured to contact a generally vertical surface of the playset, the second surface of the second stop lip configured to position the lateral support member a distance from the playset.

6. The cap of claim 5, wherein the body portion forms a pocket for receiving the end portion of the lateral support member.

7. The cap of claim 5, further including a handgrip formed integrally therewith.

8. The ladder of claim 1, at least two of said lateral support members each including an -integrally-molded cap structure configured to secure the ladder to the playground equipment.

9. The ladder of claim 1, including at least three lateral support members.

* * * * *